US005606920A

United States Patent [19]

Meyer et al.

[11] Patent Number: 5,606,920

[45] Date of Patent: Mar. 4, 1997

[54] LINKABLE MODULAR TABLE

[75] Inventors: Kevin L. Meyer, Hudsonville; David F. Lyons, Grosse Pointe Farms, both of Mich.; Jorge Q. Davies, Hanworth, England; Stephen Heron; Roberto G. Fraquelli, both of London, England

[73] Assignee: Haworth, Inc., Holland, Mich.

[21] Appl. No.: 488,491

[22] Filed: Jun. 8, 1995

[51] Int. Cl.[6] ..... A47B 35/00

[52] U.S. Cl. ..... 108/50; 108/64; 312/223.6

[58] Field of Search ..... 108/50, 23, 64; 312/223.6, 223.1, 194, 195, 196; 240/108.1

[56] References Cited

U.S. PATENT DOCUMENTS

| | | | |
|---|---|---|---|
| D. 321,447 | 11/1991 | Newhouse . | |
| D. 330,302 | 10/1992 | Heidmann . | |
| 4,639,049 | 1/1987 | Frascaroli et al. | 108/64 X |
| 4,762,072 | 8/1988 | Boundy et al. | 108/50 |
| 4,838,177 | 6/1989 | Vander Park | 108/50 X |
| 4,879,955 | 11/1989 | Moll et al. | 108/50 X |
| 4,884,513 | 12/1989 | Newhouse et al. . | |
| 4,936,228 | 6/1990 | Capo-Bianco | 108/64 |
| 5,037,164 | 8/1991 | Weissenbach et al. | 108/50 |
| 5,083,512 | 1/1992 | Newhouse et al. . | |
| 5,094,174 | 3/1992 | Grund et al. . | |
| 5,103,741 | 4/1992 | Grund et al. . | |
| 5,154,126 | 10/1992 | Newhouse et al. . | |
| 5,183,319 | 2/1993 | Pearson et al. . | |
| 5,226,705 | 7/1993 | Rorke et al. | 108/50 X |
| 5,237,935 | 8/1993 | Newhouse et al. . | |
| 5,253,595 | 10/1993 | Heidmann | 108/64 X |
| 5,318,259 | 6/1994 | Fussler | 312/223.6 X |
| 5,394,809 | 3/1995 | Feldpausch et al. | 108/50 X |

FOREIGN PATENT DOCUMENTS

| | | | |
|---|---|---|---|
| 481878 | 4/1992 | European Pat. Off. | 312/223.6 |
| 2839770 | 3/1980 | Germany | 312/223.6 |

OTHER PUBLICATIONS

"The Teknion Office System—TeknionTwo—Panel System and Desk System" brochure, Teknion Furniture Systems, (8 pages).

Haworth "Furniture That Works—Office Desking System" brochure, Haworth, Inc., 1994 (4 pages).

Steelcase "Ellipse Desk System" Product Overview brochure, Steelcase Inc., 1994, (22 pages).

Steelcase "Ellipse Desk System" Product Overview appearance performance brochure, Steelcase Inc., (14 pages).

(List continued on next page.)

*Primary Examiner*—Jose V. Chen

*Attorney, Agent, or Firm*—Flynn, Thiel, Boutell & Tanis, P.C.

[57] ABSTRACT

A table having a horizontally enlarged worksurface, and a pair of leg assemblies fixed to the worksurface directly at the opposite end edges thereof and projecting downwardly for engagement with a floor. Each leg assembly includes an upright leg member disposed directly at the rear corner of the worksurface, and at its lower end this leg is fixed to a horizontally elongate foot which projects forwardly for engagement with the floor. The leg adjacent its upper end has a support bracket which projects forwardly directly under and fixedly secured to the worksurface in close proximity to the end edge thereof. The outer side surfaces of the leg and base are preferably vertically flat and substantially vertically coplanar, and are also substantially vertically coplanar with the end edge of the table. A cable-accommodating trough is fixed to and extends horizontally between the legs in downwardly spaced relation from the rear edge of the worksurface. This trough defines two separate channels for permitting separation of telecommunication and power cables. The trough projects a small distance beyond the rear edge of the worksurface and legs to facilitate feeding of cables from the worksurface downwardly past the rear edge thereof to the trough, and the feeding of cables directly between aligned troughs of linking tables by passing the cables directly behind the legs.

20 Claims, 11 Drawing Sheets

OTHER PUBLICATIONS

Steelcase Inc. "The art of Working brings you . . . unlimited possibilities" Ellipse brochure, (11 pages).

Various pages (8 pages) from Krueger Price List Guide for various "WorkZone" products.

Herman Miller "Newhouse Group Furniture" brochure, Herman Miller, Inc., 1988, (12 pages).

Herman Miller "Newhouse Group Furniture" Planning Information brochure, Herman Miller, Inc., 1988, (62 pages).

LINKABLE MODULAR TABLE

FIELD OF THE INVENTION

This invention relates to a desk or table which is particularly desirable for use in office or educational training environments, particularly for permitting plural such desks or tables to be disposed in aligned or linked relationship, and which facilitates the handling of electrical power and/or communication cables in association therewith.

BACKGROUND OF THE INVENTION

Numerous desks or tables having horizontally enlarged tops or worksurfaces have been provided for use in office and educational environments, and many of these employ what is commonly referred to as a C-leg. Such C-legs have a top horizontal arm which secures to the underside of the worksurface in the vicinity of one end edge thereof, which top arm joins to an upright leg which is disposed in the vicinity of the rear corner of the worksurface and projects downwardly for connection to a bottom arm or base which projects forwardly in supportive engagement with a floor. In tables of this type, the C-legs are typically disposed in their entirety under the worksurface, and are also typically positioned adjacent but spaced slightly inwardly from the end edge of the worksurface. When two or more such tables are then disposed edge-to-edge in aligned relationship (commonly referred to as "linking") such as is often done in an educational or training environment, this results in the legs of adjacent tables as disposed in the vicinity of the adjacent or abutting end edges being disposed in close but typically at least slightly spaced proximity to one another, and in many cases this spacing can be up to twelve inches or more. This not only detracts from the overall appearance inasmuch as two wholly distinct legs are thus positioned closely adjacent but spaced from one another, but this also detracts from the convenience of use and particularly the maximization of the access space below the table by minimizing the space for feet or chairs. This is particularly important in a training or educational environment since oftentimes two or more chairs will be positioned along one side of each table, and thus minimizing the supporting leg and foot structure is of importance.

In addition, such tables when used in either office or educational environments are typically provided with equipment thereon such as computers or the like which require either or both electrical power and telecommunication cabling to be readily accessible. While many of the known tables have provided some type of trough or hanger arrangement to assist in supplying power and telecommunication cables thereto, most of these prior arrangements have been less than satisfactory in this regard in terms of their ability to at least partially enclose the cables and yet provide convenient access thereof, and at the same time permit such cables to be easily and conveniently extended along a series of linked tables.

Another disadvantage of prior tables of this general type has been their inability to conveniently provide an overhead storage shelf or cabinet which is mounted on and provided as an integral part of the overall table. Most prior tables have provided a leg structure which is disposed entirely under the worksurface, as described above, and such tables have prevented any convenient and simple adaptation thereto of a strong and stable overhead storage unit as an integral part thereof. In an attempt to overcome this deficiency, some prior tables have necessarily required that access openings be formed through the worksurface, which access openings are typically in the vicinity of the rear corners of the worksurface but are spaced inwardly from the edges thereof. These access openings are then utilized to permit upright supports to be joined to the leg structure and then project upwardly through the openings for supporting an overhead storage unit. This type table arrangement, however, is undesirable in that it requires special forming of the worksurface in that special and complex openings have to be provided through the worksurface so that the worksurface is thus customized for use with an overhead storage unit. Thus, typically different worksurfaces are provided for tables with and without overhead storage units. This thus seriously detracts from the manufacturing convenience and the overall adaptability or flexibility of the various styles of tables.

It is an object of this invention to provide an improved desk or table (hereinafter referred to as a "table"), preferably a C-leg table, which overcomes many of the disadvantages associated with prior tables of this type, including many of the disadvantages summarized above, with the C-leg table of this invention being particularly desirable for use in educational or training environments wherein a plurality of such tables are disposed in aligned or linked relationship.

It is a further object of this invention to provide an improved table, as aforesaid, which possesses an improved C-leg structure which is secured to the worksurface directly at the end edge thereof, and the leg and base of the leg structure are provided with exterior side surfaces which define a generally flat vertical plane which is substantially flush with the side edge of the worksurface so that edge-to-edge abutment (i.e., linking) of two tables results in the adjacent legs being disposed in substantially adjacent abutting contact with one another, whereby the two legs effectively provide the appearance of a single leg and occupy minimal space so as to maximize the clearance or access space along and under the tables.

A still further object of the invention is to provide an improved table, as aforesaid, having a cable storage trough joined to and extending between the legs adjacent the back side of the table, which trough conveniently and accessibly defines two storage channels for receiving and conveniently accessing power and telecommunication cables therein, with the channels of the trough being positioned to project slightly rearwardly from the rear edge of the worksurface, and also rearwardly from the rear edge of the legs, both to facilitate the feeding of cables upwardly from the channels around the rear edge of the worksurface for connection to equipment mounted thereon, and for permitting the cables to readily pass behind the legs between the trough of adjacent linked tables.

Still a further object of the invention is to provide an improved table, as aforesaid, having channels defined to extend vertically upwardly in the interior of the legs and accessible by removable covers to facilitate the laying in of power and/or telecommunication cables therein.

Another object of the invention is to provide an improved table, as aforesaid, which possesses an overall appearance and specifically a leg configuration which is aesthetically desirable, which is structurally simple and durable, and which permits the height of the worksurface to be easily and incrementally adjusted if desired.

It is also an object of the invention to provide an improved table, as aforesaid, which has the main legs projecting upwardly to pass through recesses formed in the worksurface adjacent the rear corners thereof, so that the legs always pass upwardly through these recesses and terminate at upper free ends which are disposed at an elevation at or more typically above the upper surface of the worksurface, which main legs have outer flat surfaces which are substantially flush with the end edges of the worksurface, and these legs readily permit upper leg extensions to be rigidly mounted thereon and project upwardly therefrom so as to define a substantially continuous upright leg which, at the upper end, provide rigid support for an overhead storage unit which extends fixedly between the upper ends of the legs in upwardly spaced relation from the worksurface.

Another object of the invention is to provide a table with an overhead storage unit, as aforesaid, wherein the overhead storage unit can have the height thereof readily adjusted, at least incrementally, relative to the support legs.

Briefly summarizing the table according to a preferred embodiment of the invention, there is provided a horizontally enlarged top or worksurface, the upper surface of which defines a horizontally enlarged working surface. A pair of leg assemblies which are substantially mirror images of one another are fixed to the worksurface directly at the opposite end edges thereof and project downwardly for supportive engagement with a floor. Each leg assembly includes an upright leg member disposed directly at the rear corner of the worksurface, and at its lower end this leg is fixed to a horizontally elongate foot or base which projects forwardly for supportive engagement with the floor. The leg adjacent its upper end has a support arm or bracket fixed thereto, which fixation may permit incremental height adjustment, and this support arm projects forwardly generally parallel with the base and is disposed directly under and fixedly secured to the worksurface in close proximity to the end edge thereof. The outer side surfaces of the leg and base are preferably vertically flat and substantially vertically coplanar, and are also substantially vertically coplanar with the end edge of the table. When two such tables are disposed edge-to-edge in aligned or linking relationship, the flat side surfaces of the adjacent leg structures substantially abut and effectively define what appears to be a single leg at the junction of the two tables to provide desirable aesthetics and minimum obstruction of the space under the tables.

The table of the invention, in a preferred embodiment, is provided with a cable-accommodating trough which is fixed to and extends horizontally between the legs in downwardly spaced relation from the rear edge of the worksurface. This trough defines two separate channels extending therealong which are conveniently accessible for permitting separation of telecommunication and power cables, with at least one of the troughs preferably having a removable longitudinally-extending cover. The trough preferably projects rearwardly of the worksurface a small distance beyond the rear edge of the worksurface and legs to facilitate feeding of cables from the worksurface downwardly past the rear edge thereof to the trough, and the feeding of cables directly between aligned troughs of linking tables by passing the cables directly from the open end from one trough behind the legs into an open end of an adjacent trough.

The table of this invention, in a preferred embodiment, and as aforesaid, has the legs positioned so as to project through recesses formed directly at the rear corners of the worksurface, whereby the legs project upwardly to an elevational at or slightly above the working surface and this enables the provision of a continuous fixed-height leg which provides a desirable and continuous appearance and at the same time enables the height of the table to be incrementally adjusted. This leg at the upper end is also provided with structure such that, by removal of a top cap, an upper leg extension can be fixed to and project upwardly therefrom so as to define a substantially continuous vertical extension of the leg, with the upper leg extension permitting an overhead storage unit to be fixedly mounted to and extend horizontally between the upper leg extensions in upwardly spaced relation from the worksurface.

Other objects and purposes of the invention will be apparent to persons familiar with structures of this general type upon reading the following specification and inspecting the accompanying drawings.

Figure 1:
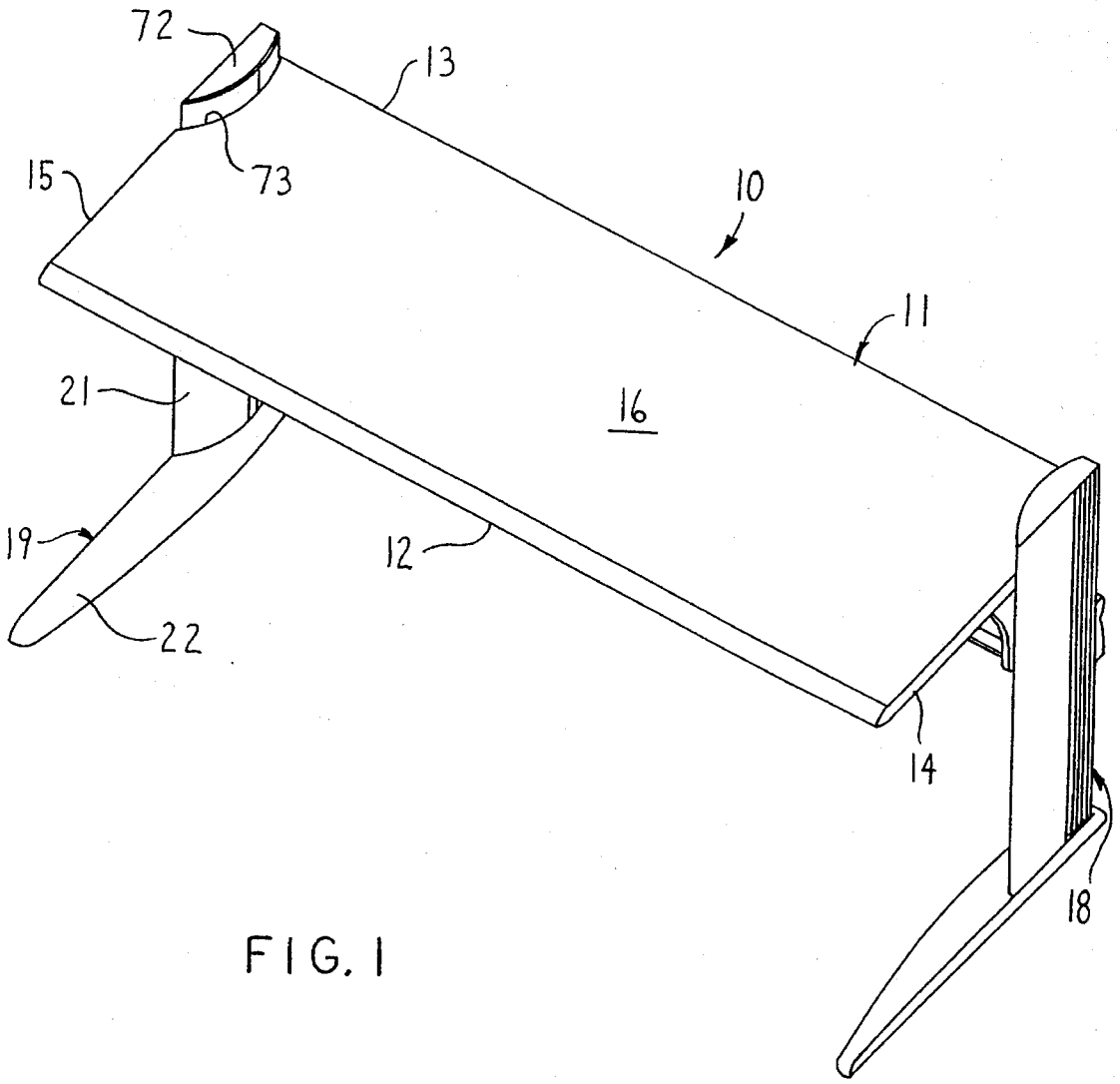
FIG. 1 is an isometric view of a table according to the present invention.
Figure 2:
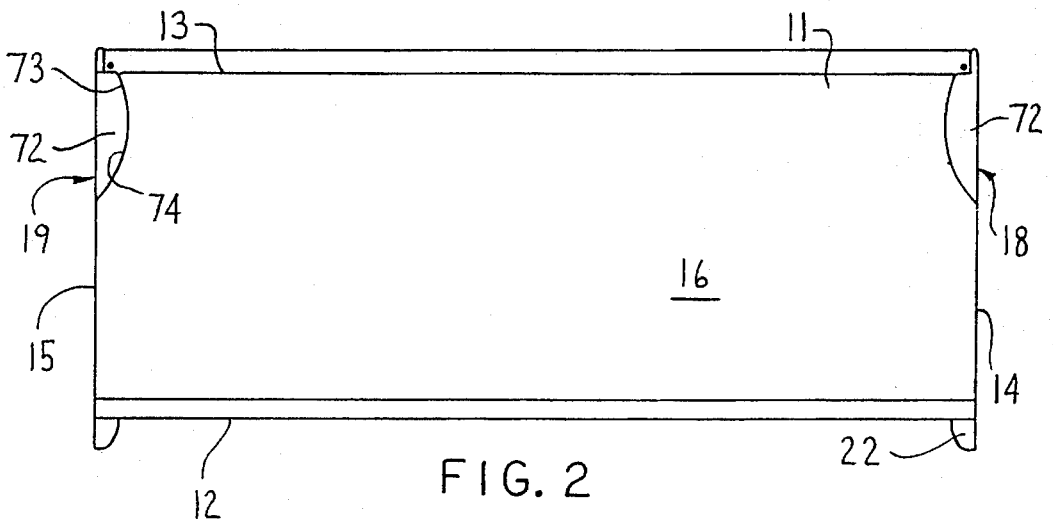
FIGS. 2, 3 and 4 are respective top, front and rear views of the table shown in FIG. 1.
Figure 3:
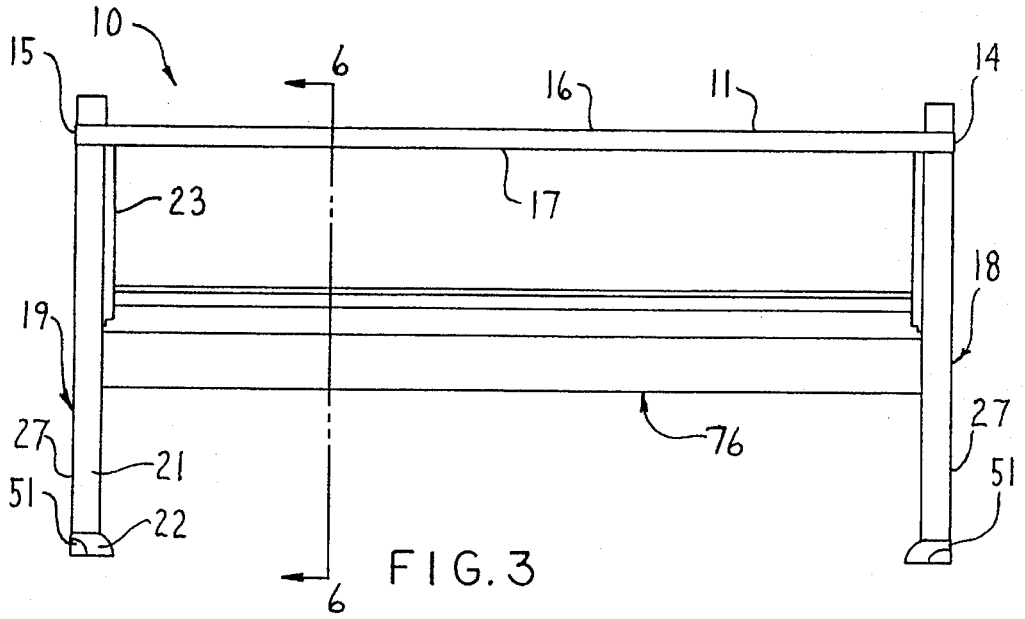
Figure 4:
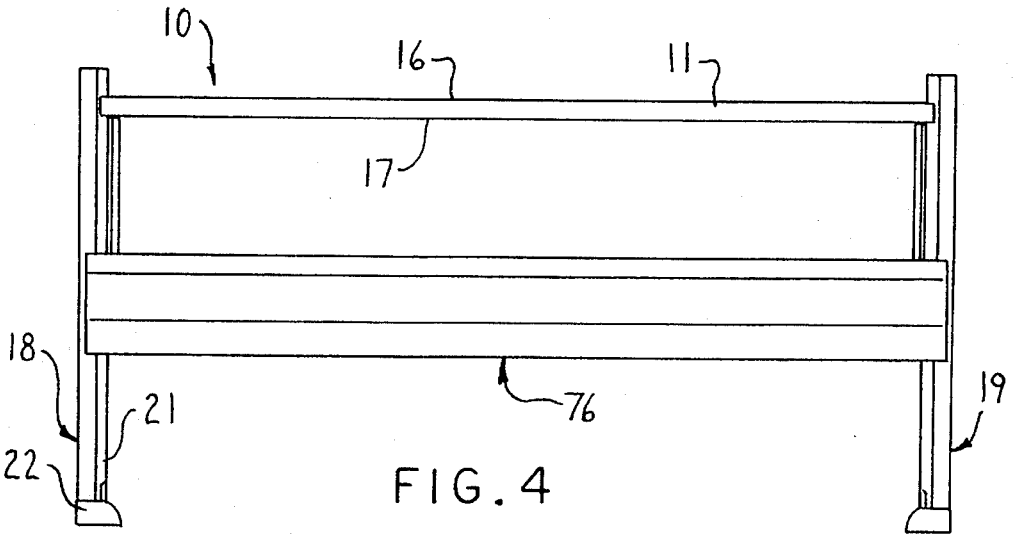
Figure 5:
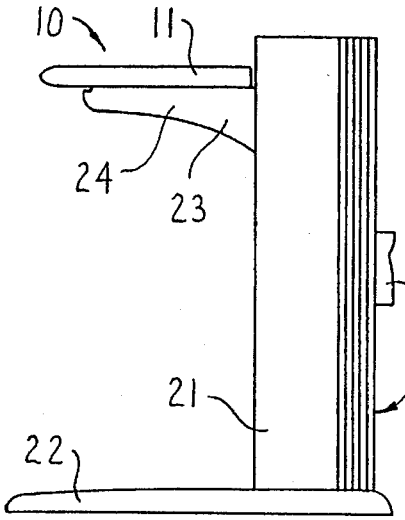
FIG. 5 is a right-side elevational view of the table of FIG. 1.
Figure 6:
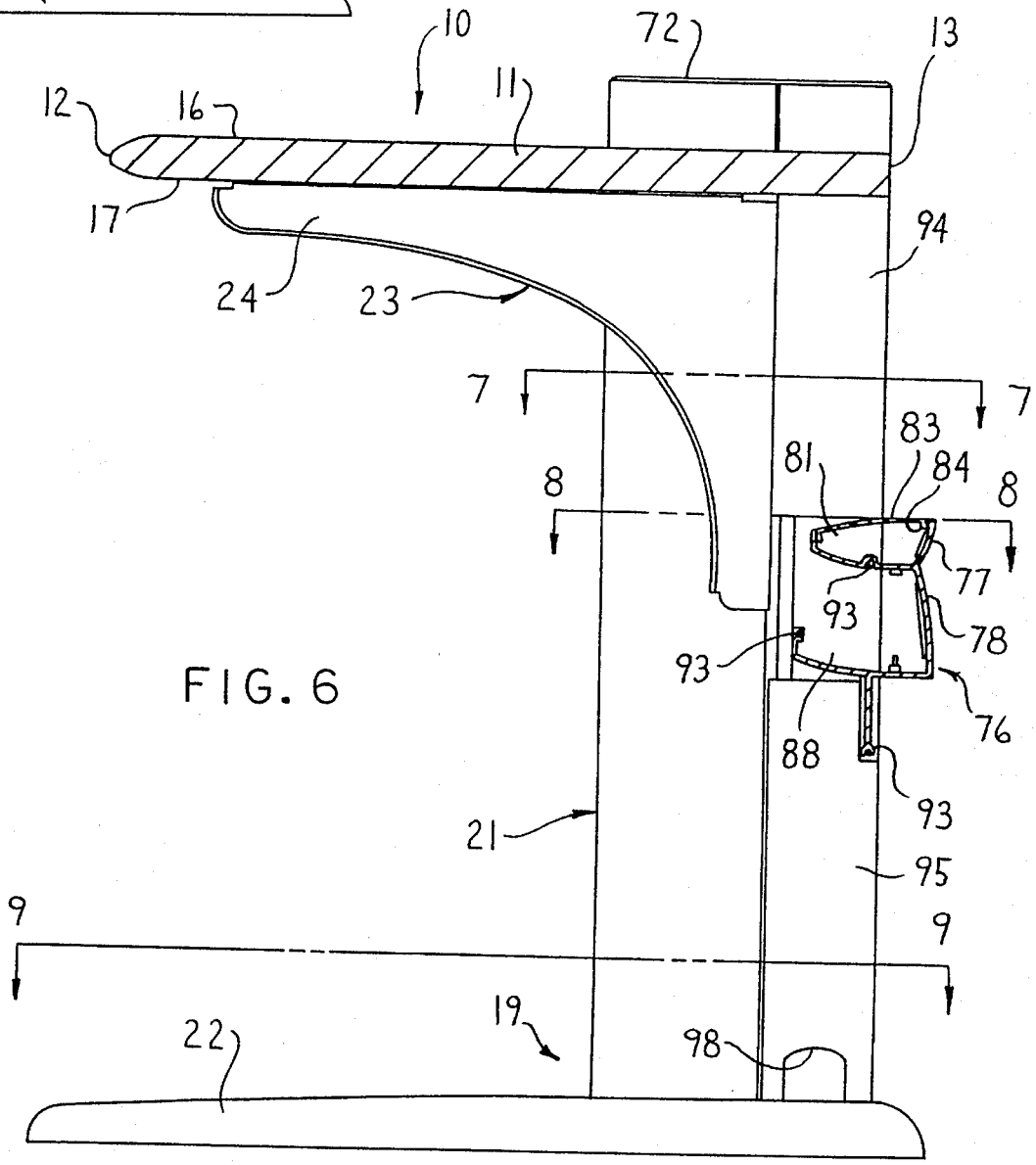
FIG. 6 is an enlarged elevational view, in cross section, as taken generally along line 6—6 in FIG. 3.
Figure 8:
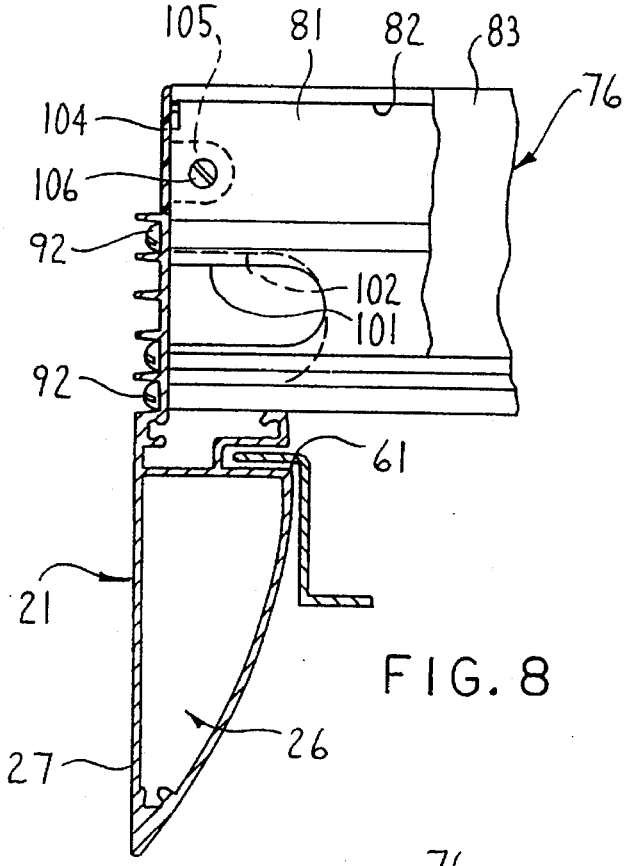
FIGS. 7, 8 and 9 are sectional views taken along lines 7—7, 8—8 and 9—9, respectively, as appearing in FIG. 6.
Figure 9:
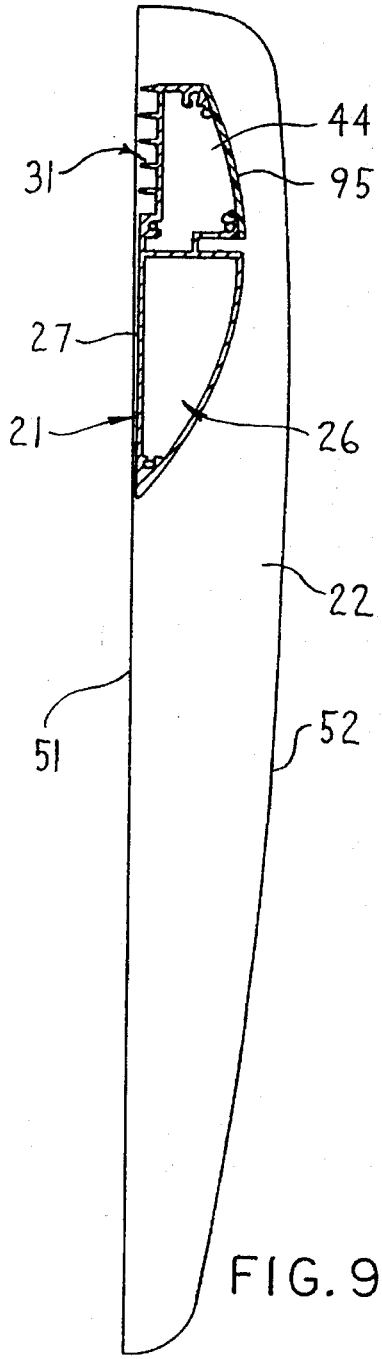

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the normal vertical relationship of the table in its upright use position. The word "front" will be used to designate the edge or side of the table worksurface closest to the occupant, and the word "rear" will refer to the worksurface edge remote from the user, these respectively being the left and right sides of the worksurface as shown in FIG. 5, and the words "right" and "left" will refer to the ends of the table as viewed from the front edge. The words "inwardly" and "outwardly" will refer to directions toward and away from, respectively, the geometric center of the table and designated parts thereof. Said terminology will include the words specifically mentioned, derivatives thereof, and words of similar import.

DETAILED DESCRIPTION

Referring to the drawings and specifically FIGS. 1–5, there is illustrated a desk or table 10 according to the invention. This table includes a generally horizontally enlarged platelike top 11 which in the illustrated embodiment is of a substantially rectangular shape and includes generally parallel front and rear edges 12 and 13, respectively, joined by generally parallel side or end edges 14 and 15. The top has an upper surface 16 spaced from the bottom surface 17, with the upper surface 16 being a substantially planar and horizontally enlarged working surface.

The top 11 is supported in generally parallel and upwardly spaced relationship from a support surface (i.e., a floor) by right and left leg assemblies 18 and 19 which fixedly join to and project downwardly from the top 11 adjacent opposite ends thereof. The leg assemblies 18 and 19 are substantially identical except for being mirror images of one another relative to the transverse (i.e., front-to-back) direction of the table. The following description will relate to the left leg assembly 19, it being understood that the right leg assembly 18 is otherwise substantially identical thereto.

The leg assembly 19 is of a generally C-shaped configuration which opens toward the front edge of the table and includes a main upright support leg 21 which at its lower end is fixedly joined to a horizontally elongated foot or base 22, the latter being adapted to be supported on the floor and having the leg 21 fixed adjacent the rearward end thereof so that the foot 22 projects forwardly in generally parallel relation with the respective worksurface side edge 15. The leg assembly 19 also includes a support bracket 23 which is fixed to the main leg 21 adjacent the upper end thereof and includes a horizontally elongate arm 24 which projects forwardly directly under and in supportive and fixed engagement with the worksurface 11 in close proximity to the side edge 15. This support arm 24 is spaced upwardly from and extends generally parallel with the foot 19, and the worksurface 11 fixes to the arm 24 in a conventional manner by fasteners such as screws or clips.

The construction of the leg member 21 will now be considered in detail, particularly with reference to FIGS. 7–10.

The main support leg 21 is preferably formed as a vertically elongate one-piece hollow member, such as by being extruded from aluminum, and includes a tubular front part 26 which in the preferred and illustrated embodiment is generally three-sided and includes a flat outer side wall 27 joined to a generally perpendicular or transverse inwardly projecting rear wall 28, with a convex arcuate inner wall 29 being joined between the front and inner edges of the respective walls 27 and 28. The tubular front part 26 of the leg generally resembles a triangular cross section, with the longest leg of the triangle being inwardly and forwardly facing and being of an outwardly curved or convex configuration.

The support leg 21 also has a generally channel-shaped rear part 31 which projects rearwardly from the front part 26 but extends longitudinally therethrough the length of the leg member and defines a generally U-shaped or channel-like configuration which opens longitudinally inwardly toward the opposite end of the table. This channel-shaped rear part 31 includes an outer side wall 32 which in effect defines the base of the channel-shaped configuration, and projects rearwardly in contiguous relationship from the outer side wall 27 of the front tubular part. This outer side wall 32 in the illustrated embodiment is of a generally shallow Z-shaped cross section in that the front leg 33 is coplanar and contiguous with the outer side wall 27 and projects rearwardly a limited distance therefrom, with this front leg 33 being joined through a short bridge part to a rear leg 34 which projects rearwardly and is disposed generally parallel with but spaced slightly inwardly from the front leg 33. The rear leg 34 has a plurality of spaced but generally parallel vertically extending ribs 35 projecting from the outer surface thereof, the latter providing both structural rigidity and decorativeness. The tips of these ribs 35 terminate generally within the vertical plane defined by the exterior side of the outer side wall 27.

The channel-shaped rear part 31 has a rear wall 36 which joins to the rear edge of the rear leg 34 and projects inwardly a limited extent, terminating in a free edge having a small forwardly projecting flange 37 formed thereon. The other (i.e. front) side of the channel-shaped rear part 31 is defined in part by an edge wall 38 which extends generally parallel with and is spaced rearwardly a small distance from the rear wall 28 so as to define a vertically elongate channel or slot 39 therebetween which opens longitudinally inwardly of the table. This edge wall 38, in the illustrated embodiment, is rigidly joined to the rear wall 28 through an intermediate bridge wall 41. The edge wall 38 at its free end is provided with a rearwardly projecting flange 42 thereon. The flange 42 is spaced generally in opposed and forwardly spaced relation from the flange 37, which flanges thus define a vertically elongate access opening 43 therebetween which extends longitudinally throughout the leg member and provides access to the channel-shaped space or compartment 44 defined by the rear part 31.

Figure 10:
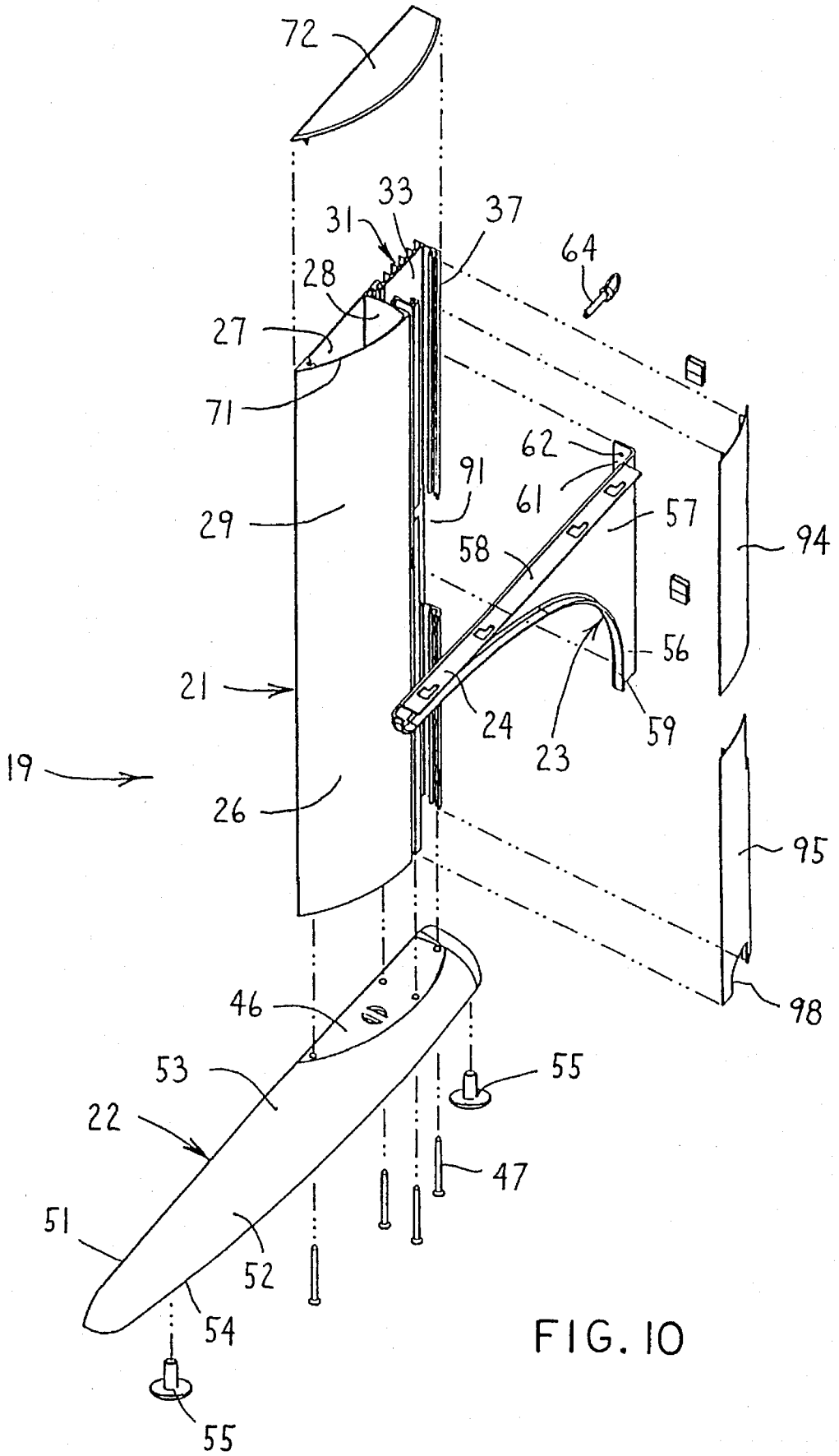
FIG. 10 is an exploded perspective view of the leg assembly.
Figure 11:
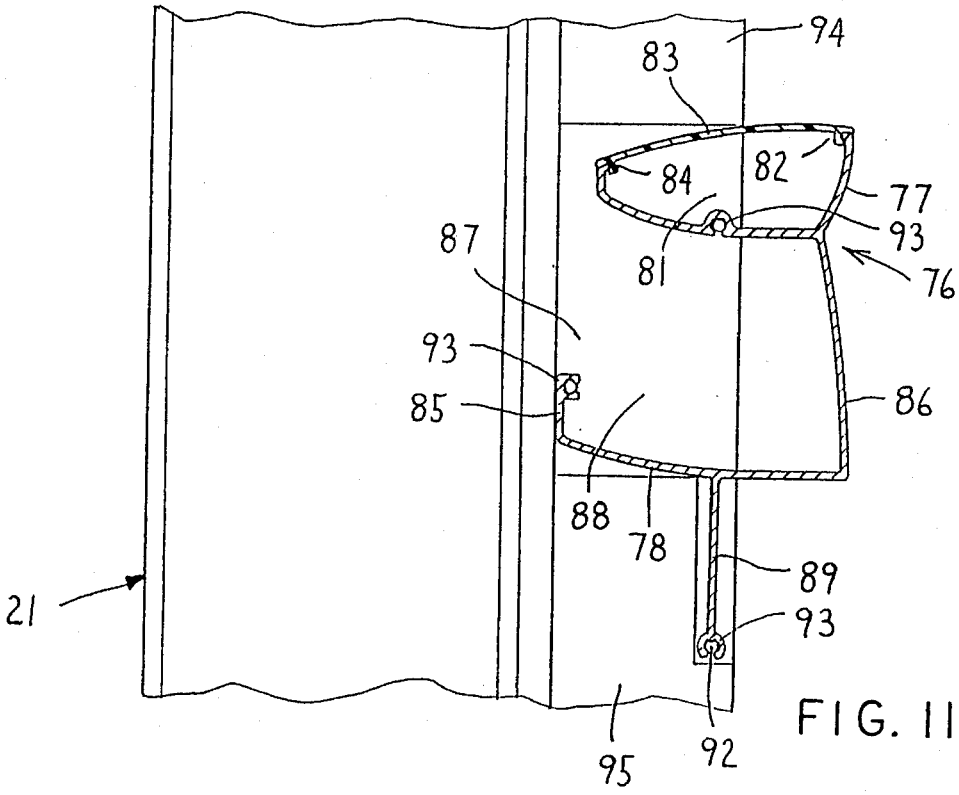
FIG. 11 is an enlarged sectional view of the cable trough as appearing in FIG. 6.

The lower end of the leg member 21 is fixed to the foot 22 which, as illustrated by FIG. 10, has a horizontally flattened upper surface 46 adjacent the rearward end thereof for accommodating an engagement with the lower free end of the leg 21. A plurality of elongate fasteners such as screws 47 project upwardly through suitable openings in the foot 22 into engagement with suitable openings formed longitudinally along the leg member, two such openings being designated at 48 in FIG. 7.

The foot 22 is preferably formed as a horizontally elongate one-piece rigid member, such as by being cast or molded of metal such as aluminum, and includes a generally vertically flat outer side surface 51 which is substantially vertically coplanar with the outer side surface 27 of the leg member 21. The foot 22 has an inner side surface 52 which is provided with a slight convex configuration throughout the length thereof so that the foot is of somewhat narrower width at the front end, with this inner side surface 52 adjacent the front and rear ends of the foot being suitably convexly rounded so as to define rounded corners at the front and rear ends of the foot which merge with the flat outer side surface 51. This inner side surface 52 as it projects upwardly is also convexly rounded for merger with a convexly rounded top surface 53 which in turn joins to the vertically flat outer side surface 51. The foot defines thereon a generally horizontally flat bottom surface 54, and is also preferably provided with support glides 55 threadedly adjustably mounted on the underside thereof adjacent opposite ends thereof, such glides being conventional.

The upper end of the leg 21 is, as briefly described above, interconnected to the worksurface 11 by the support bracket 23 which is generally L-shaped and in addition to the horizontal arm 24 which projects under the worksurface, also has a vertical arm 56 which projects downwardly for fixed connection to the leg 21. The support bracket 23 is defined by a vertically-extending plate member 57 which defines the generally L-shaped configuration, the latter having transverse flanges extending along the free edges thereof including a top flange 58 which underlies the worksurface, an arcuate bottom flange 59, and a vertically extending rear flange 61. This flange 61 projects longitudinally sidewardly in a direction away from the other flanges 58 and 59, and is directed longitudinally toward the adjacent leg member 21. This flange 61 projects into the vertically elongate channel 39 and, in the preferred embodiment, can be vertically displaced along this channel so as to permit selected deposition of the worksurface at a desired incremental height. For this purpose, the flange 61 has at least one opening 62 extending therethrough adjacent the upper end thereof, as shown in FIG. 10. Similarly, the walls 28 and 38 which define the channel 39 also have a plurality of aligned openings 63 formed horizontally therethrough in vertically spaced relation so as to traverse the channel. Accordingly, the support 23 is disposed with the flange 61 vertically positioned in the channel 39 at the desired elevation so that the opening 62 is aligned with one of the openings 63, and an appropriate conventional spring-detent pin 64 is extended through the aligned openings, as illustrated by FIG. 7, to fixedly secure the support bracket 23 to the leg member 21 at the desired height.

Figure 7:
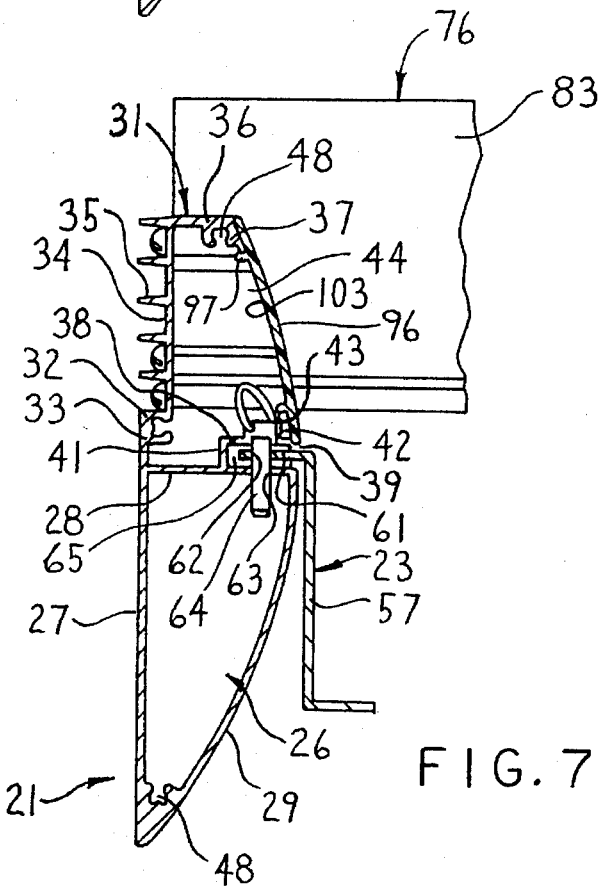

The channel 39, as illustrated by FIG. 7, is preferably provided with a generally U-shaped glide 65, typically of a hard plastic material, to snugly sandwiched the flange 61 within the channel 39. The connecting pins 64 are conventional and well known, and typically have a pull ring at one end, and a resiliently outwardly-urged ball detent projecting transversely adjacent the other end thereof. This thus permits the connecting pins to be easily inserted or removed when assembly or height adjustment is desired.

The leg 21 is provided with a height such that the upper end 71 thereof, which upper end is normally closed off by means of a removable top cap 72, is disposed at or above the elevation of the upper working surface 16, depending on the height-adjustment position of the worksurface 11. For this purpose, the worksurface 11, adjacent each rear corner thereof, is provided with a cutout or recess 73 which extends vertically through the worksurface and in effect removes the corner thereof. This corner cutout or recess 73 is defined by a concave wall having a configuration which generally corresponds to the inside configuration of the leg so that this concave wall 74 at its forward end terminates at the respective side edge 14, with the wall then curving inwardly and rearwardly so as to terminate at the rear edge 13. This enables the leg member 21 to project vertically upwardly into and entirely through the corner cutout or recess 73, with the cross section of the leg member entirely occupying this recess. This results in the vertically flat exterior side surface 27 of the leg member being substantially vertically coplanar with the worksurface side edge 15, and results in the rear wall 36 of the leg member being substantially aligned with the rear worksurface edge 13. This results in the top cap 72 substantially totally occupying the corner cutout or recess when the worksurface is at its maximum height, with the leg projecting upwardly above the worksurface when the worksurface is disposed at any height lower than its uppermost maximum, such being illustrated in FIG. 1.

The table 10 of this invention also preferably has a cable trough 76 extending horizontally and connected between the right and left leg assemblies 18 and 19. The cable trough 76 is preferably disposed at an elevation about midway between the worksurface 11 and the floor, and is disposed so that the horizontal and longitudinally extending centerline thereof is generally parallel with the worksurface rear edge 13 and is positioned approximately directly vertically thereunder.

As shown in FIGS. 6–8 and 11, the cable trough 76 includes, throughout the longitudinal extent thereof, an upper channel part 77 which is disposed substantially directly over and rigidly join to a lower channel part 78. The upper channel part 77 is of a generally upwardly-opening channel-like configuration which defines therein an interior lengthwise extending trough or channel 81 for accommodating cables therein. This upper channel 81 is accessible through a top mouth or opening 82 which extends longitudinally the entire length of the cable trough. This top mouth 82 is preferably closed by a removable top cover 83 which extends lengthwise of the trough and has a pair of downwardly projecting tabs or flanges 84 adjacent opposite side edges thereof for creating a resilient but releasable engagement with beads or flanges which extend along the upper free edges of the upper channel part 77.

The lower channel part 78 is disposed substantially directly below the upper channel part 77 and is also upwardly oriented but has a front side leg or wall 85 which is of lesser height than the rear side leg or wall 86, the latter wall 86 having the upper end thereof rigidly joined to the upper channel part 77. The reduced height of the front side leg 85, however, results in the upper edge thereof being spaced downwardly from the upper channel part 77 so that there is defined a mouth or opening 87 which extends lengthwise of the cable trough and opens through the front side of the lower channel part 78 so as to provide access to the cable-accommodating channel or compartment 88 which extends longitudinally thereof.

The cable trough 76, in the illustrated embodiment, is preferably formed in one piece of a plastics material, such as by being extruded. To provide additional strength or stiffening, a flange or wall 89 is fixed to and projects vertically downwardly a limited extent from the center of the bottom wall of the lower channel part, and extends longitudinally therealong.

The opposite ends of the cable trough 76 project into the channel-shaped space 44 defined by the rear parts 31 of the support legs 21 so that each free end of the trough 76 is disposed so as to substantially abut or at least be positioned closely adjacent the vertically projecting leg wall 34. The rear leg part 31, in the region of the cable trough, has the rear leg 36 removed so as to define a vertically elongate cutout 91 (FIG. 10) for enabling the channel trough to extend up to the wall 34 and still project rearwardly therefrom. The end of the trough 76 is fixedly connected to the respective support leg 21 by a plurality of fasteners such as screws 92 which extend through suitable openings in the leg wall 34 and engage within longitudinally extending flanges or beads 93 defined by the cable trough, there being three such screws 92 and cooperating beads 93 in the illustrated embodiment.

The cable trough 76 is horizontally disposed, in the front to rear direction of the table, such that the rear wall thereof is positioned horizontally rearwardly a small distance, such as about one to two inches, from a rear vertical plane defined by the rear edges of the worksurface 11 and legs 21. The cable trough 76, however, also projects forwardly a small distance from this rear vertical plane, as clearly shown in FIGS. 6 and 11.

The rear channel part 31 of each leg 21 is, both above and below the cable trough 76, closed off by respective upper and lower elongate leg covers 94 and 95. Each of these covers has a generally identical cross section, preferably being extruded as a plastic member, and has a main platelike cover part or wall 96 which is of a slight arcuate or convex curvature having a configuration which is consistent with the exterior curvature of the front arcuate inner wall 29. This cover part 26 has sidewardly spaced and inwardly projecting retaining flanges 97 which resiliently and releasably engage the edge flanges 37 and 42 so as to close off the vertically extending channel 44.

The upper leg cover 94 extends from an elevation substantially at the top of the cable trough 76, upwardly to the upper end of the leg 21. The lower lege cover 95 has its upper end disposed substantially directly under the cable trough 76, and then projects downwardly so as to terminate at the upper surface of the foot 22. This lower leg cover 95, at its lower free end, has an archlike opening 98 formed therethrough for permitting cables to pass therethrough for access to the closed channel 44 defined behind the lower leg cover.

To permit cable access between the upper and lower portions of the closed channel 44 as defined within the rear leg part 31, and the horizontal channels 81 and 88 defined by the cable trough 76, the cable trough 76 adjacent each free end thereof has a first access opening 101 formed through the bottom wall of the lower cable part 78, this opening 101 being disposed within the rear leg part and providing direct vertical communication with the channel 44. The bottom wall of the upper channel part 77 has a further access opening 102 therethrough which is disposed substantially directly over the opening 101 and provides direct access between the channels 81 and 88. Similarly, the removable top cover 83 at the free end thereof is provided with a notchlike recess 103 at the front corner thereof, the latter defining a further access opening which opens upwardly for communication with the closed channel 44 defined in the upper portion of the leg 21.

Use of the table 10 as described above is believed self-evident, but will be hereinafter briefly described to ensure a complete understanding thereof.

When only a single table 10 is provided and used, electrical power and communication cables can be extended from a floor location to the channels 81 and 88. One of the power and telecommunication cables can be laid into the upper channel 81, preferably with the top cover 83 removed, with the cover thereafter being snapped back onto the cable trough to close off the top channel. The other of the power and telecommunication cables will preferably be disposed in the lower channel 88, such being possible by merely laying the cable into the channel through the open front mouth 87. The cables extend lengthwise along the respective channels and can then be fed downwardly through the access openings 101 and 102 into the channel 44 and thence downwardly therealong to the floor. After then cables have been fed downwardly along the channel 44, the lower leg cover is repositioned on the rear leg part to close off the channel 44, with the cables accessing the channel through the lower opening 96.

With power or telecommunication cables provided as described above, equipment disposed on the worksurface can then be readily connected thereto. For example, the power and telecommunication cables or cords which extend from the equipment on the worksurface can be fed over and downwardly around the rear edge 13 of the worksurface, with one of the cables being insertable into the lower channel 88 through the open front mouth thereof. The other cable is permitted to access the upper channel 81 by being inserted therein when the cover 83 is removed, with the cable then being positioned so as to pass between the end of the cover 83 and the lower end of the upper leg cover 94.

Figure 12:
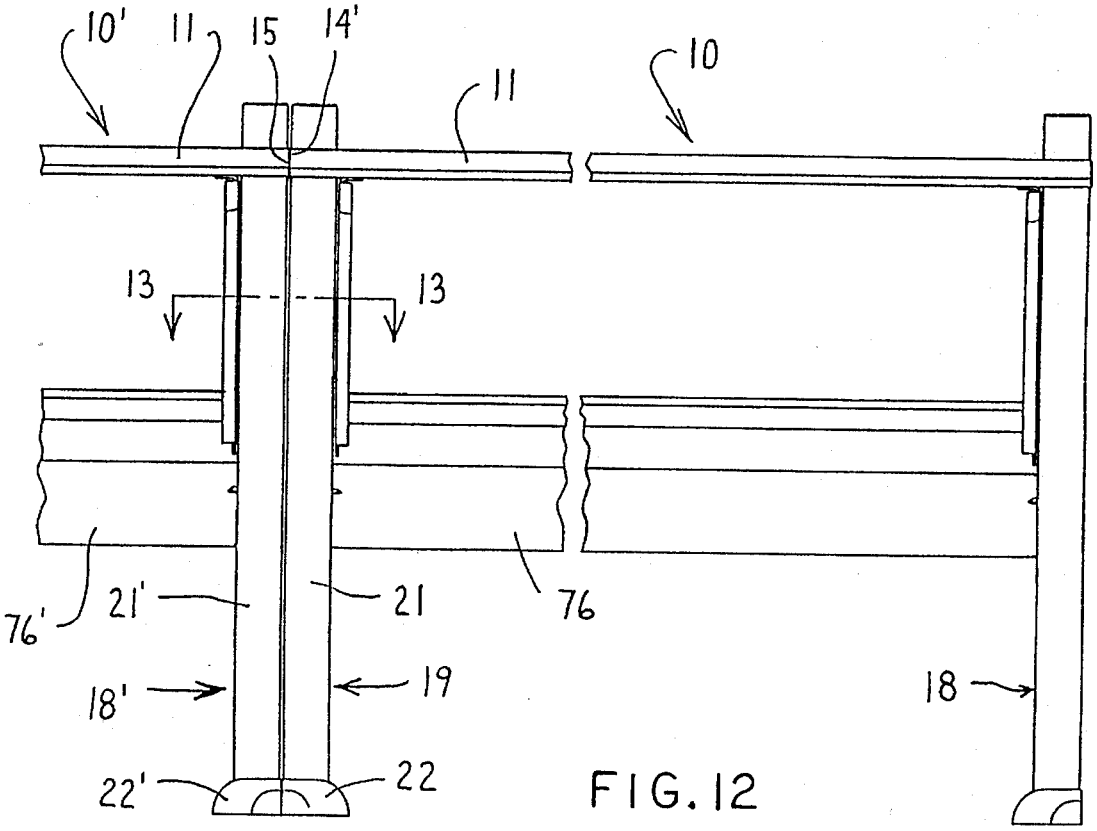
FIG. 12 is a fragmentary front view showing two tables disposed in adjacent edge-to-edge relationship, this typically being known as "linking".

When two or more tables 10 are disposed in a linking relationship so that the tables are disposed in directly adjacent and longitudinally aligned relationship wherein the end edges 14' and 15 of two adjacent tables substantially abut, as shown by the two tables designated 10 and 10' in FIG. 12, the two directly opposed and adjacent leg assemblies 18' and 19 are disposed substantially in abutting engagement since the flat vertical side surface of each foot and upright leg is substantially vertically coplanar with the respective worksurface side edge 14' and 15, and thus the two adjacent leg assemblies 18' and 19 effectively provide the appearance of a single leg arrangement at the junction between the two tables, thereby greatly minimizing the space occupied by the leg assembly, and in fact providing a leg arrangement which is of highly improved appearance since the configuration of the leg 21 and foot 22 of the leg assembly 19 is a mirror image of the configuration of the same parts defined on the leg assembly 18', so that the two merge together and thus define a overall leg arrangement having the same mirror-image configurations on opposite sides of a central vertical plane as defined between the opposed and substantially abutting flat side surfaces. With the two tables in the linking position, the feet 22 of the adjacent leg assemblies 18' and 19 are preferably joined together, as by an upwardly opening connecting channel element (not shown) which is inserted into the feet from the bottom sides so as to hold the opposed flat side walls together and prevent separation between the adjacent tables.

It will be appreciated that the exterior side surface of side wall 27 may be spaced horizontally inwardly on extremely small distance from the respective foot side surface 51, this being primarily for manufacturing and assembly purposes so as to ensure that end edges 14' and 15 can properly abut when adjacent tables are linked together.

Figure 13:
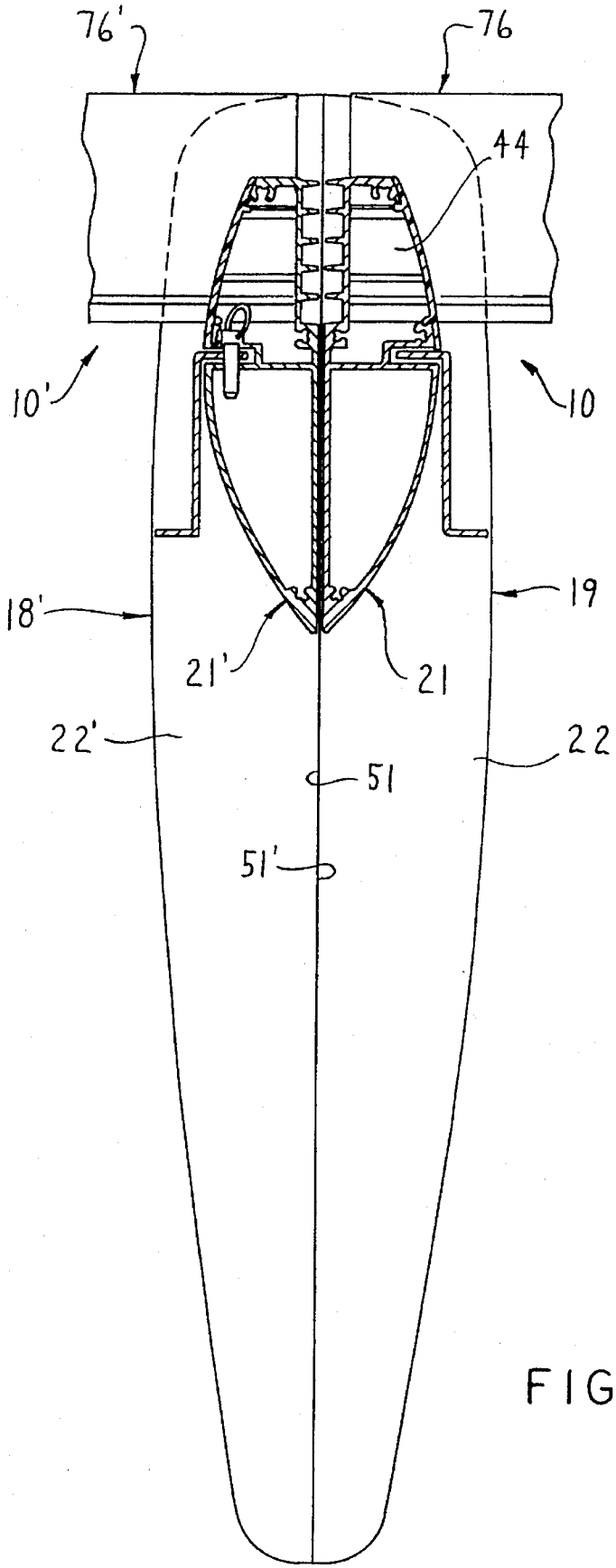
FIG. 13 is an enlarged sectional view taken generally along line 13—13 in FIG. 12.
Figure 14:
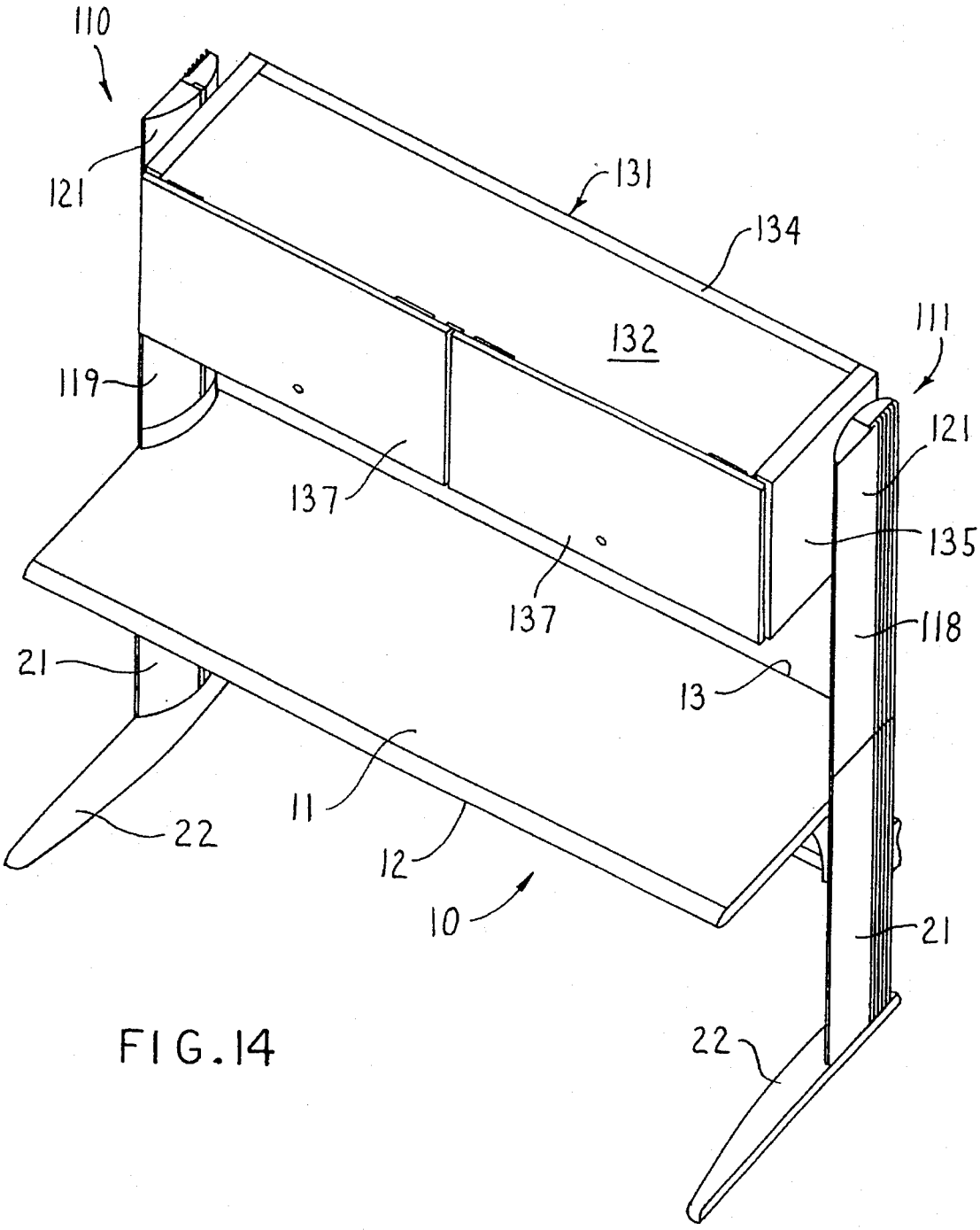
FIG. 14 is a perspective view showing the table of this invention with an overhead storage unit mounted thereon so as to define a workstation.
Figure 15:
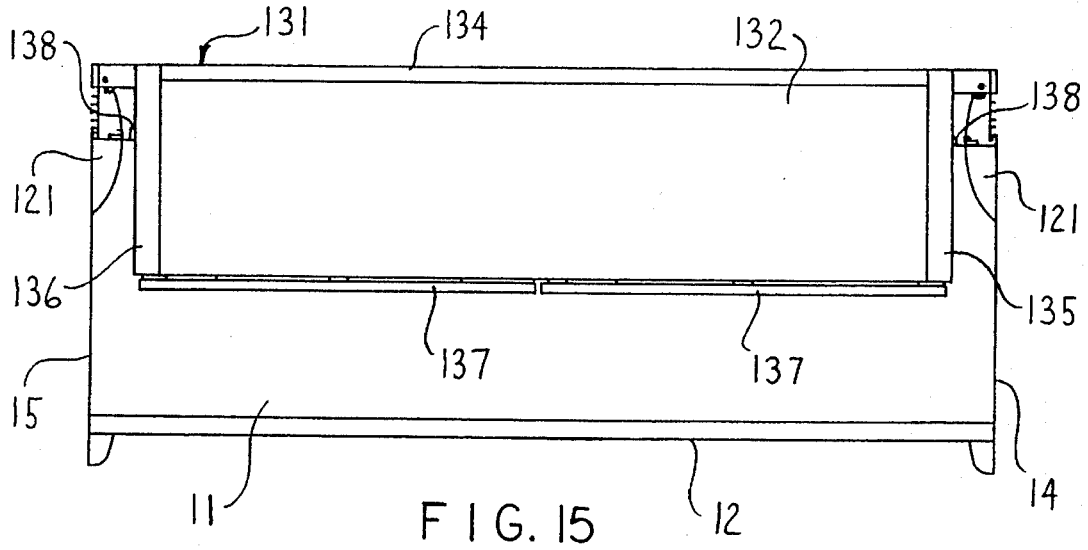
FIGS. 15, 16, 17 and 18 are top plan, front elevational, rear elevational and right-side elevational views, respectively, of the workstation of FIG. 14.
Figure 16:
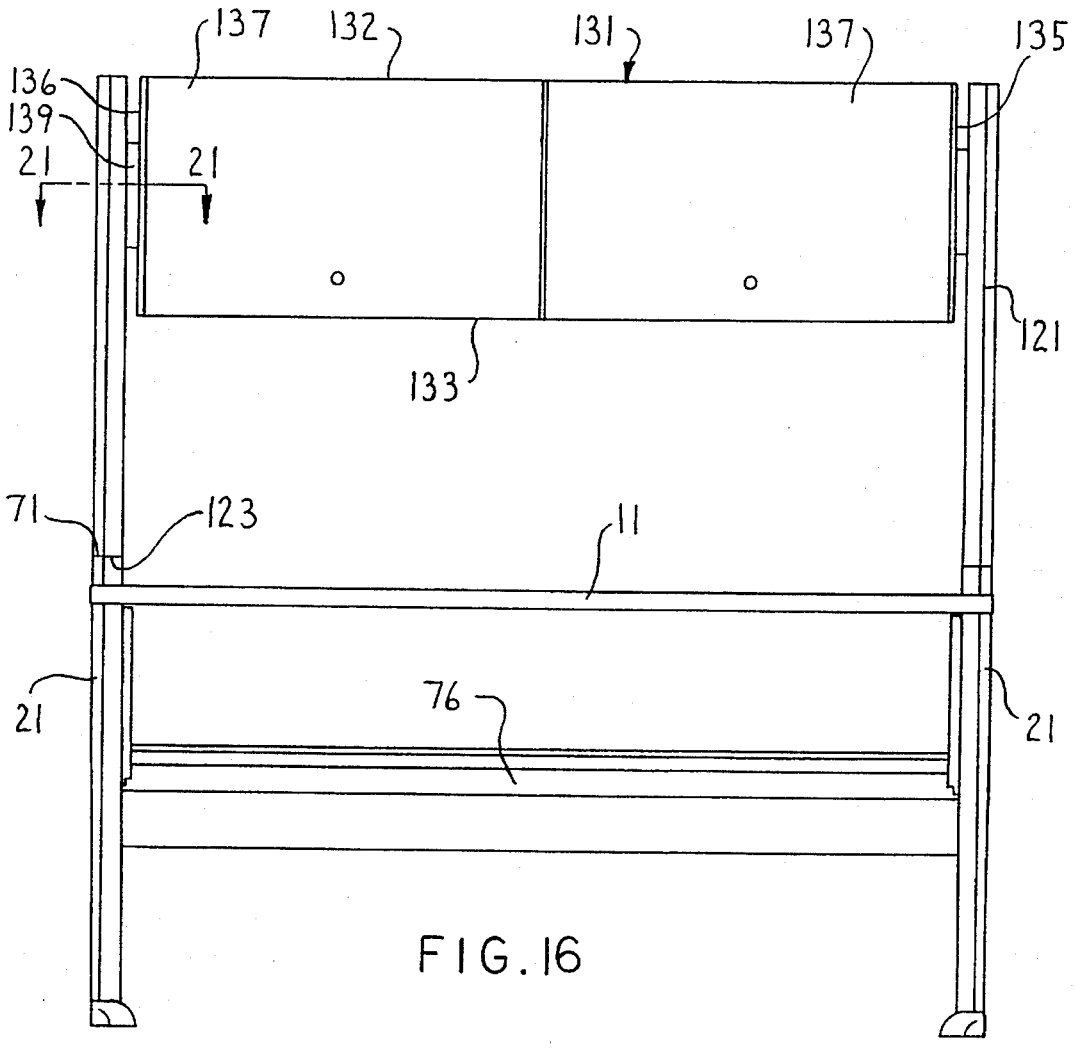
Figure 17:
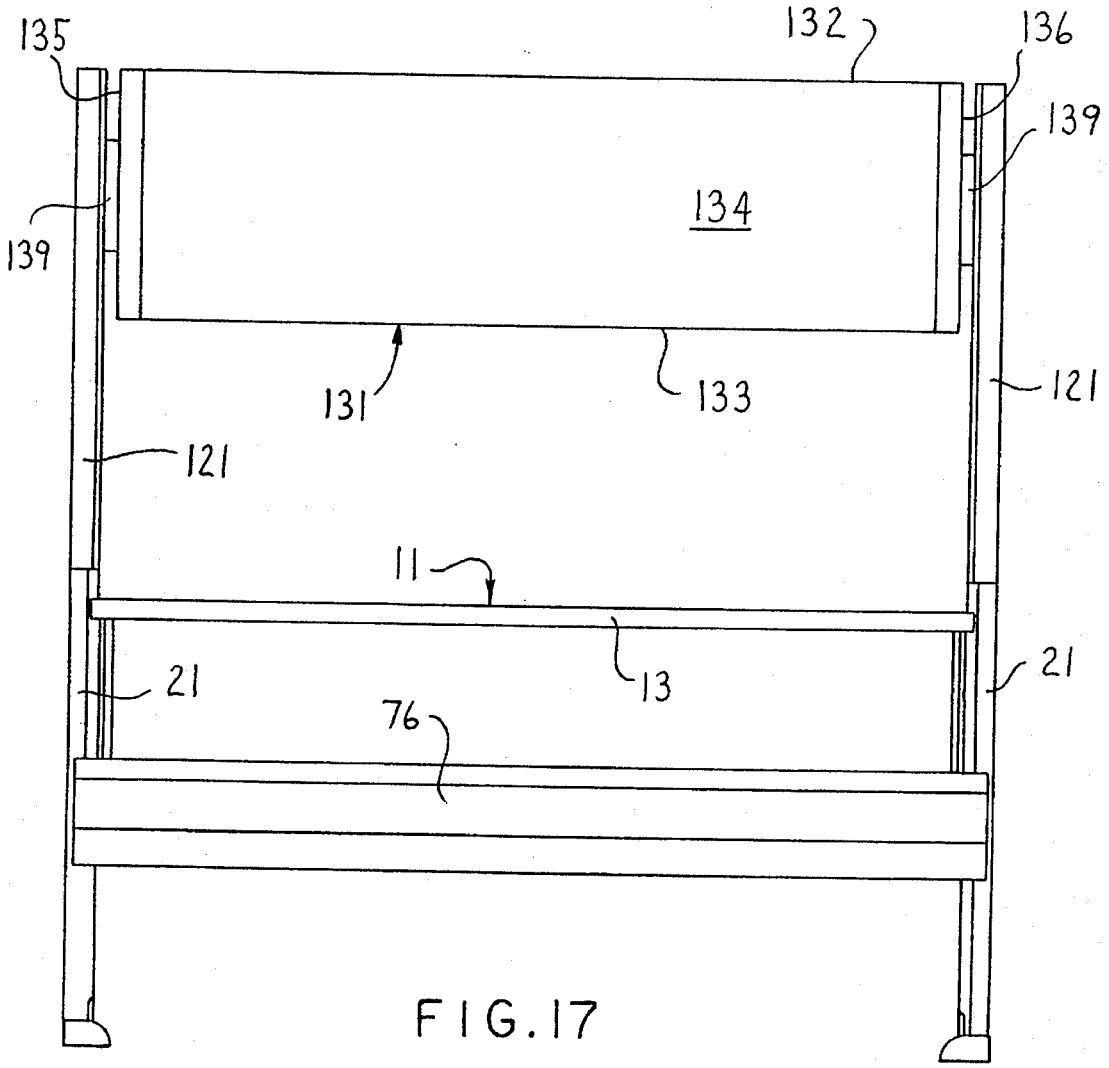
Figure 19:
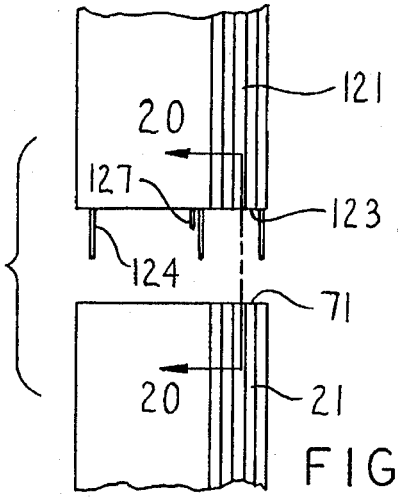
FIG. 19 is an enlarged, exploded, fragmentary view showing the manner in which the adjacent ends of the upper and lower posts rigidly join together.
Figure 20:
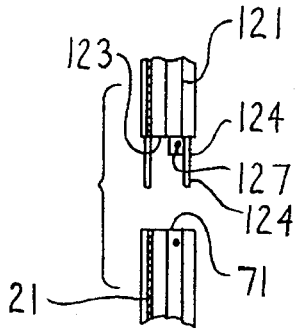
FIG. 20 is a view taken along line 20—20 in FIG. 19.
Figure 18:
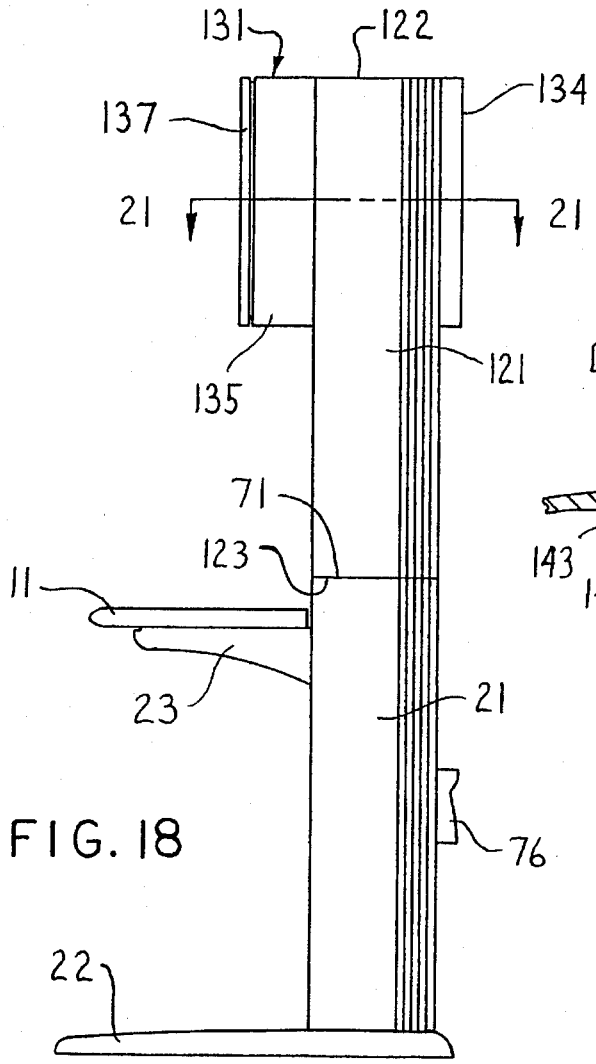
Figure 21:
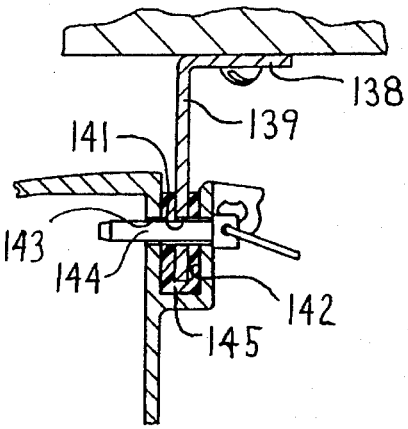
FIG. 21 is an enlarged fragmentary sectional view taken generally along line 21—21 in FIG. 18.

When the tables are in the linking position shown in FIG. 12, the cable troughs 76 of the two linked tables are horizontally aligned as shown in FIG. 13, and the opposed ends are disposed closely adjacent one another. Since the cable troughs 76 project rearwardly a small distance beyond the rear wall of the legs 21, this thus enables the channels 81 and 88 of the cable trough 76 on the table 10 to be in open aligned communication with the respective channels 81 and 88 associated with the trough 76' on the table 10'. Power or telecommunication cables which are disposed within one trough can be readily passed outwardly through the open end of the respective channel 81 or 88 behind the legs 21 into the aligned channel 81 or 88 of the adjacent cable trough. This facilities the transference of power or telecommunication cables throughout the aligned troughs of several linked tables. Since the upper channel 81 has a removable cover, this permits the cable to be effectively laid downwardly into the aligned upper channels 81 of several linked tables merely by passing the cables rearwardly of the legs 21, thereby eliminate the need to fish the cables through enclosed openings.

If desired, particularly in a situation where the free end of the cable trough 76 is exposed (such as at the end of a series of linked tables), the open end of the trough 76 can be suitably closed off by a removable cover plate 104 (FIG. 8) which effectively aligns with and projects rearwardly from the leg side wall 34 and abuts the end of the cable trough. This cover plate 104 has a flange 105 which projects inwardly in underlying relationship to the bottom wall of the upper channel part, with the latter then being fixedly joined, as by means of a fastener or screw 106.

Considering now FIGS. 14–21, there is illustrated a variation of the invention. In this variation there is provided a freestanding workstation 110 which includes the table 10 described above and as illustrated by FIGS. 1–10, which table 10 in turn fixedly mounts thereon an overhead arrangement 111. This overhead arrangement 111 includes respective right and left upper leg extensions 118 and 119 which fixedly mount on and project upwardly in aligned relationship from the respective right and left leg assemblies 18 and 19 of the table. These right and left upper leg extensions 118 and 119 are identical except for being mirror images of one another.

Each of the upper leg extensions 118 and 119 is formed primarily by a vertically elongate upper leg member 121 which is preferably extruded of aluminum and has a cross section which in shape and size is substantially identical to the cross section of the main support leg 21 as illustrated in FIG. 7 so that further detailed description of the upper leg member 121 is believed unnecessary.

The upper leg member 121 terminates at upper and lower free ends 122 and 123, respectively. The upper leg member is adapted to abuttingly seat on and project upwardly in aligned relationship from the respective main leg member 21, whereby the lower free end 123 of the upper leg member abuttingly engages the upper free end 71 of the respective main leg member 21. To fixedly couple the leg members 21 and 121 together, the upper leg member 121 has a plurality (here three) of securing pins 124 fixed thereto and projecting downwardly from the lower end thereof. These pins 124 project downwardly and are snugly retained in the openings 48 which are formed in the upper end of the leg member 21. A flange 127 is also fixed to and projects downwardly from the upper leg member 121 so as to project into the slot 39 of the lower leg member 21, and a suitable fastener such as a screw (not shown) extends through this flange into the wall of the lower leg member so as to provide a fixed securement between the leg members 21 and 121. This fixed and abutting relationship between the main leg member 21 and the upper leg member 121 defines a structurally and visually continuous upright leg which projects upwardly a substantial extent above the worksurface 11.

The upper leg members 121, in the vicinity of the upper ends thereof, are rigidly joined together by an overhead storage unit 131 which extends horizontally therebetween in upwardly spaced relationship from the worksurface 11. This overhead storage unit 131 in the illustrated embodiment comprises a generally closed cabinet having generally parallel and horizontally extending top and bottom walls 132 and 133, respectively, rigidly joined by a vertically extending back wall 134, and additionally joined to vertically extending right and left side walls 135 and 136, respectively. The cabinet defines therein a storage compartment which is accessible through the front side, which side in the illustrated embodiment is closed by front doors 137 which are connected by hinges (not shown) along their outer edges to respective front edges of the right and left side walls. The construction of the cabinet as briefly described above is conventional.

Each side wall 135 and 136 of the overhead storage unit 131 has a generally vertically-elongate L-shaped mounting bracket 138 fixed thereto, which bracket is oriented so that one leg or flange 139 thereof projects horizontally outwardly in perpendicular relationship to the respective side wall toward the adjacent upper leg member 121. This flange 139 has at least one opening 141 formed therethrough adjacent the upper end thereof. The flange 139 projects into the vertically elongated and inwardly opening slot 142 formed in the adjacent upper leg member 121, whereupon the opening 141 is adapted to align with a selected one of a series of vertically spaced openings 143 formed through the side walls of the slot 142. The flange 139 on the overhead unit is vertically selectively positioned in one of several incremental height positions so that opening 141 in the flange 139 aligns with the selected opening 143 associated with the slot, and a conventional detent-type securing pin 144 is inserted through the aligned openings at the upper end of the flange to fixedly and stationarily secure the overhead unit 131 to and rigidly between the upper leg members 121 in the selected height position. A U-shaped plastic glide 145 is preferably disposed in the slot 142 for receiving the flange 139. This connection of the leg or flange 139 within the slot of the upper leg member by means of connecting pin 144 is identical to the connection between the support brackets 23 and the main legs 21 as described above and as illustrated in FIG. 8.

With the overhead storage unit or cabinet 131 mounted on the upper leg members 121, the storage unit is spaced vertically upwardly a substantial distance above the worksurface 11, and the front of the cabinet as defined by the front doors 137 is disposed rearwardly a substantial distance from the front edge of the worksurface. At the same time, however, the rear of the storage unit as defined by the back wall 134 thereof is preferably disposed within a vertical rear plane which is spaced rearwardly from the rear edge of the worksurface and is preferably generally vertically aligned with the rear vertical edge of the cable trough 76.

With the table 10 of the present invention, or with the freestanding workstation 110, the table or workstation can be positioned directly adjacent and substantially in abutting engagement with a vertical wall. Any contact with the wall, however, occurs against the rear of the cable trough 76, or against the rear of the overhead cabinet 131, thereby ensuring that the rear edge 13 of the worksurface always remains horizontally spaced a small clearance distance away from the fixed wall so as to facilitate passage of power or telecommunication cables around this rear edge for extension to the cable trough 76. Similarly, the rear walls of the upright legs themselves are also spaced a small horizontal distance forwardly from the fixed wall to again define a clearance space which facilities passage of power or telecommunication cables sidewardly behind the legs.

While the overhead storage unit 131 illustrated and described above comprises a closed cabinet, it will be apparent that the storage unit may assume other configurations, including being an open shelf unit.

The workstation 110 allows power and telecommunication cables to be routed therealong in the same manner described above relative to the table 10, and in addition permits a plurality of such workstations to be linked end-to-end in the same manner illustrated and described with respect to FIGS. 12 and 13 above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a freestanding C-leg table having a horizontally enlarged worksurface defining thereon an enlarged and planar upper surface, said worksurface defining thereon a pair of end edges, and a pair of leg assemblies fixed to said worksurface and projecting downwardly therefrom for supportive engagement with a floor, each leg assembly being fixed to the worksurface and projecting downwardly in adjacent relationship to one of the end edges thereof, said leg assembly including a vertically upright leg which is positioned adjacent a rear corner of the worksurface and projects vertically downwardly and at its lower end is fixed to a horizontally elongate foot which projects forwardly and is adapted for supportive engagement with the floor, comprising the improvement wherein said worksurface has a cutout which opens inwardly from each of the respective end edges in the vicinity of the respective rear corner of the worksurface and extends vertically upwardly through the worksurface, said leg having an upper portion which is positioned within and projects vertically through said cutout so that the leg has an upper end which is disposed at or above the upper surface of said worksurface, said leg having a configuration which corresponds generally to the contour of the cutout so as to snugly fit therein, said leg having an outer side surface which defines a flat vertically-extending plane which is substantially vertically coplanar with the respective end edge of the worksurface, and said foot having an outer vertically-flat side surface which is substantially vertically coplanar with the respective end edge of the worksurface.

2. A table according to claim 1, wherein said leg has an inner side surface which is of a generally rounded convex configuration which horizontally terminates at front and rear edges which join with said flat outer side surface.

3. A table according to claim 1, wherein said leg has front and rear parts which are rigidly joined and project vertically throughout the length thereof, said front part being a hollow tube having a continuous surrounding side wall, and said rear part being of channel-shaped cross section defining therein a vertically elongate channel which opens inwardly, and a removable cover for closing off said channel.

4. A table according to claim 3, including a cable trough extending horizontally between and fixed to the upright legs positioned adjacent opposite end edges of the table, the cable trough defining therein first and second horizontally-extending cable-accommodating channels which are separate from one another and extend longitudinally between said legs, said cable trough being disposed at an elevation approximately midway between the worksurface and the floor, the cable trough being positioned substantially directly vertically under a horizontally extending rear edge of the worksurface so that the cable trough projects horizontally rearwardly and forwardly relative to said rear edge.

5. A table according to claim 4, wherein said upright legs have a rear wall which is substantially aligned with the rear edge of the worksurface.

6. A table according to claim 4, wherein one of the horizontal channels is disposed generally vertically over the other said channel, said one channel having an opening closed by a removable cover extending lengthwise of the trough, and said other channel being accessible through an opening which extends longitudinally of the trough and opens through a front wall thereof.

7. A table to according to claim 4, wherein each of said first and second horizontal channels of said cable trough are disposed substantially vertically directly one over the other and each includes a front portion which at the opposite ends thereof opens directly into the vertical channels of the respective legs, each of said horizontal cable channels also including a rear portion which at opposite ends open longitudinally directly behind the respective upright legs so as to permit free passage of cables therebehind.

8. The table of claim 1, wherein each leg assembly includes a horizontally elongated top arm which is disposed directly under and in supportive engagement with the underside of the worksurface adjacent a respective end edge thereof, and a height-adjustable joint structure joining a rearward end of said top arm to the respective upright leg for permitting the arm and the worksurface supported thereon to be vertically incrementally adjusted relative to the floor, said joint structure including a vertically elongated and horizontally sidewardly projecting flange fixed to said top arm and projecting sidewardly into a vertically elongate slot formed in the respective upright leg, said leg having walls defining said slot, said walls and said upright flange having openings which cooperate for alignment and which receive a removable securing pin therein.

9. In a freestanding table having a horizontally enlarged platelike worksurface defining thereon a generally horizontally extending and enlarged upper surface, and a pair of leg assemblies fixed to and projecting downwardly from said worksurface adjacent opposite end edges thereof for supportive engagement with a floor, each leg assembly including a rigid upright leg member extending vertically and having an upper part thereof fixed to said worksurface in the vicinity of a rear corner thereof, and a horizontally elongated support foot fixed to a lower end of said leg member and projecting horizontally forwardly therefrom in supportive engagement with the floor, and a horizontally elongate cable trough extending longitudinally of the table, comprising the improvement wherein said cable trough is fixed to and extends horizontally between said upright leg members at an elevation about midway between the worksurface and the floor, said cable trough being disposed substantially directly vertically under a rear horizontally extending edge of said worksurface and including an elongate trough member defining therein first and second longitudinally extending cable-accommodating channels which are disposed substantially vertically directly one above the other, said trough member and said first and second channels being defined at least in part by a rear longitudinally extending wall member which defines a rear side of each of said first and second channels and is disposed horizontally rearwardly at least a minimal distance from a rear vertical plane containing the rear edge of the worksurface, and said upright leg members having rear vertically projecting edges which do not project rearwardly of said rear vertical plane, said first and second channels at opposite ends of said trough member opening longitudinally outwardly directly adjacent but rearwardly of the upright leg members for permitting passage of cables through said channels and thence past the rear of said leg members.

10. A table according to claim 9, wherein said trough member has an upwardly directed and horizontally elongate upper opening which opens downwardly into said first channel over the elongated length thereof for permitting laying in of cables, a removable cover being removably engaged with said trough member for closing off said upper opening of said first channel, and said trough member having an elongate slotlike front opening extending longitudinally thereof and opening solely into said second channel from the front side thereof.

11. A table according to claim 9, wherein said upright leg member includes a front tubular part and a rear channel part which are rigidly and integrally joined and project vertically longitudinally of the leg member, said rear channel part defining therein a vertically elongate channel-like space which is accessible through an open side of the channel member which faces inwardly toward the upright leg member disposed at the opposite end of the table, said trough member extending between and being rigidly joined to the rear channel parts of said upright leg members so that said first and second channels of said trough member directly communicate with the vertically extending channel-like spaces in said upright leg members.

12. A table according to claim 11, including upper and lower removable covers engaged with the rear channel part of each upright leg member respectively above and below the trough member for closing off the open side of the channel-like space, whereby power and/or telecommunication cables can extend vertically of said channel-like space and thence horizontally into said first and second channels.

13. A table according to claim 11, wherein at least the front tubular part of said upright leg member has an outer side surface which is flat and disposed within a vertical plane which is substantially coplanar with the respectively adjacent end edge of the worksurface, the respective foot also having an outer side surface which is flat and disposed within substantially the same vertical plane as the flat side surface on said leg member, whereby two tables can be disposed in substantially abutting end edge-to-end edge relationship so that the legs and feet of the adjacent tables substantially abuttingly contact at the directly opposed flat outer side surfaces thereof.

14. A table according to claim 13, including upper and lower removable covers engaged with the rear channel part of each upright leg member respectively above and below the trough member for closing off the open side of the channel-like space, whereby power and/or telecommunication cables can extend vertically of said channel-like space and thence horizontally into said first and second channels.

15. A table according to claim 11, wherein said trough member has an upwardly directed and horizontally elongate upper opening which opens downwardly into said first channel over the elongated length thereof for permitting laying in of cables, a removable cover being removably engaged with said trough member for closing off said upper opening of said first channel, and said trough member having an elongate slotlike front opening extending longitudinally thereof and opening solely into said second channel from the front side thereof.

16. In a freestanding workstation having a horizontally enlarged worksurface supported in upwardly spaced relation from a floor by upright base legs, and an overhead storage unit positioned in upwardly spaced relation over said worksurface and supported therefrom by intermediate legs, said base and intermediate legs being disposed adjacent opposite end edges of the worksurface, comprising the improvement wherein each of said base legs comprises an upright lower leg member fixed to a horizontally projecting support foot at a lower end thereof and projecting upwardly and terminating in an upper end which is disposed at an elevation equal to or above an upper surface of said worksurface, and said intermediate leg comprising a vertically elongate upper leg member which has a lower end thereof seated on and fixedly secured to said lower leg member and projecting upwardly therefrom in aligned relation therewith, said upper and lower leg members having the same cross-sectional configuration so as to cooperate and effectively define a continuous leg member throughout the vertical length thereof, and said overhead storage unit extending horizontally between and being fixedly mounted to said upper leg members adjacent upper ends thereof, the lower leg member projecting upwardly through a cutout formed in an end edge of the worksurface, the lower leg member also having an outer flat side surface which is substantially vertically coplanar with the end edge of the worksurface, and said upper leg member also having an outer flat side surface which is coplanar with the outer flat side surface of the lower leg member to effectively define a vertical extension thereof.

17. A workstation according to claim 16, wherein a mounting bracket is secured to each end of the storage unit and includes a vertically elongate mounting flange which projects horizontally into a vertically elongate slot formed in the upper leg member, said mounting flange and said slot having a series of alignable openings therethrough, and a connecting pin removably positioned through a pair of aligned openings for fixedly securing said storage unit in one of a plurality of different height positions.

18. The table according to claim 9, wherein each said leg assembly further includes an upper leg member engaging said upper portion of said upright leg member, said upper leg member having the same cross-section configuration as said upright leg member so as to cooperate and define a continuous leg member throughout the vertical length thereof, and further comprising an overhead storage unit extending horizontally between and being fixedly mounted to said upper leg members adjacent upper ends thereof.

19. The table according to claim 9, wherein each leg assembly includes a horizontally elongated top arm which is disposed directly under and in supportive engagement with the underside of the worksurface adjacent the end edges thereof, and a height-adjustable joint structure joining a rearward end of said top arm to the respective upright leg member for permitting the arm and the worksurface supported thereon to be vertically incrementally adjusted relative to the floor, said joint structure including a vertically elongated and horizontally sidewardly projecting flange fixed to said top arm and projecting sidewardly into a vertically elongate slot formed in the respective upright leg member, said leg member having walls defining said slot, said walls and said upright flange having openings which cooperate for alignment and receiving a removable securing pin therein.

20. The table according to claim 1, wherein each said leg assembly further includes an upper leg engaging said upper portion of said upright leg, said upper leg having the same cross-section configuration as said upright leg so as to cooperate and define a continuous leg throughout the vertical length thereof, and further comprising an overhead storage unit extending horizontally between and being fixedly mounted to said upper legs adjacent upper ends thereof.

* * * * *